United States Patent [19]

Borcuch et al.

[11] Patent Number: 4,821,523

[45] Date of Patent: Apr. 18, 1989

[54] METHOD AND APPARATUS FOR RELIABLE GAS SUPPLY

[75] Inventors: John P. Borcuch, Williamsville; David R. Thompson, Grand Island, both of N.Y.

[73] Assignee: Union Carbide Corporation, Danbury, Conn.

[21] Appl. No.: 176,220

[22] Filed: Mar. 31, 1988

[51] Int. Cl.[4] ..... F17C 7/02
[52] U.S. Cl. ..... 62/52
[58] Field of Search ..... 62/52

[56] References Cited

U.S. PATENT DOCUMENTS

| | | | |
|---|---|---|---|
| 2,833,121 | 5/1958 | Dorf | 62/1 |
| 3,012,408 | 12/1961 | Perkins et al. | 62/52 |
| 3,435,623 | 4/1969 | Tyree, Jr. | 62/52 |
| 3,726,085 | 4/1973 | Arenson et al. | 62/52 |
| 4,226,605 | 10/1980 | Van Don | 62/52 |
| 4,399,660 | 8/1983 | Vogler et al. | 62/52 |
| 4,409,927 | 10/1983 | Loesch et al. | 122/26 |
| 4,519,213 | 5/1985 | Brigham et al. | 62/52 |

*Primary Examiner*—Ronald C. Capossela
*Attorney, Agent, or Firm*—Stanley Ktorides

[57] ABSTRACT

A gas supply system comprising an atmospheric vaporizer and a powered heat exchanger in series each having a rated capacity at least equal to the design gas usage rate.

17 Claims, 1 Drawing Sheet

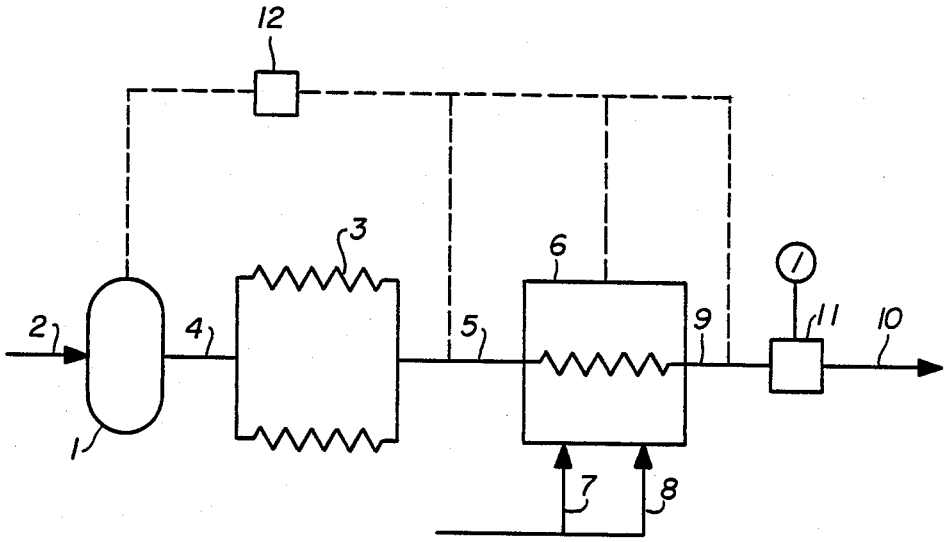
12
3
6
2
4
5
9
11
10
1
7
8

METHOD AND APPARATUS FOR RELIABLE GAS SUPPLY

TECHNICAL FIELD

This invention relates to the field of gas supply wherein liquid is heated to become product gas and then is passed to a usage point.

BACKGROUND ART

Gases, such as oxygen, nitrogen or argon, are used in a large number of different applications. For example, oxygen is used for metals production, such as stainless steel refining, and by hospitals for life support, and nitrogen and argon are used for inert gas blanketing of chemically reactive processes and for inert gas purging of flammable or explosive furnace atmospheres.

Because of the very significant volume reduction of the liquefied gas, the gases are generally transported in liquid form to the usage site such as the factory or hospital, and stored as liquid at the usage site in a liquid storage tank, As the usage point, i.e., the hospital or factory requires gas, the liquefied gas is passed out of the storage tank, at pressure or pumped if necessary, heated to vaporize the liquid and warm the cold gas to close to ambient temperature, and then passed on to the usage point.

The liquefied gas is heated generally in one of two ways, either by heat exchange with ambient air or by heat exchange with a heated fluid.

The use of an atmospheric vaporizer to vaporize the liquefied gas offers the advantage of reduced energy usage since the heat for liquid to warm gas conversion is attained from the ambient air at no cost. One disadvantage of an atmospheric vaporizer is the comparatively large size that is needed to heat liquid to achieve any given flowrate compared to the size of a powered heat exchanger to achieve the same flowrate. Another disadvantage of an atmospheric vaporizer is unreliability due to the buildup of frost or ice on the atmospheric side of the heat exchange surfaces. The rate of this buildup is affected by a large number of variable and uncontrollable factors such as the ambient temperature, the relative humidity, the wind velocity, the solar exposure and the type and amount of precipitation. Thus, frost or ice buildup may occur in a highly irregular pattern which gives rise to the possibility of unexpected vaporizer fouling and thus the inability to supply product gas to the use point at the requisite usage rate.

The use of a powered heat exchanger to vaporize the liquefied gas offers the advantage of much reduced size, to achieve any given vaporization and gas flow rate, as compared to an atmospheric vaporizer. However, the use of a powered heat exchanger requires significant expenditure for energy. Furthermore the reliability of a powered heat exchanger is highly dependent on the reliability of the power supply. Should power be cut off, the powered heat exchanger will very rapidly reach a state wherein it is unable to supply product gas to the use point at the requisite usage rate.

Whether an atmospheric vaporizer or a powered heat exchanger is used to vaporize the liquefied gas is an engineering decision based, inter alia, on the space availability, equipment costs, and the power costs at a particular usage site.

Whichever type of heat exchanger is employed it must be sized properly so that its rated capacity is at least equal to the required or design gas usage rate at the usage site. While the rated capacity may be somewhat in excess of the gas usage rate, it is not desirable that the rated capacity significantly exceed the gas usage rate because of the incurrence of an unnecessarily high initial capital cost. Furthermore, design overcapacity does not solve the reliability problems discussed above. An overly large powered heat exchanger will become inoperable essentially just as quickly as a powered heat exchanger or the correct size once the power is cut off, and an atmospheric vaporizer will foul due to frost and ice buildup essentially just as erratically whether it is sized correctly or has a rated capacity much larger than needed.

One system that has been used to heat liquefied gases comprises an atmospheric vaporizer to raise the product temperature from cryogenic, e.g., about −300° F., to near ambient temperature, i.e., about −50° F., and then a small heater to raise the product temperature to close to ambient temperature of about 50° F. This system, although more complicated than a system using a single type of heat exchanger, may be more efficient in that it takes advantage of the large temperature gradient between atmospheric and cryogenic conditions to raise the product temperature to near ambient conditions and then, as the temperature gradient shrinks and the rate of heat exchange decreases for an atmospheric unit, the powered heater boosts the heat exchange rate to get the product gas to ambient temperature. Typically in such a system the atmospheric vaporizer has a rated capacity of about 80 percent of the required heat duty and the heater has a rated capacity of about 20 percent of the required heat duty. While this system may offer certain advantages in efficiency it does not address the reliability problems discussed above.

Liquid storage and vaporization systems are intended to operate for long periods without direct monitoring by personnel. Furthermore, these systems are often used as gas backup supply for critical applications where loss of product gas would cause significant material in progress losses or expose equipment or personnel to damage or danger. Thus the issue of reliability is very important and it is very desirable to have a system which exhibits greater reliability than do presently available systems. One way to increase reliability is to have a complete backup system ready to operate once the primary system fails. However, this method may not adequately address the reliability problems. For example, a power loss may affect the backup and associated controls just as it affects the primary unit.

Accordingly, it is an object of this invention to provide a method for more reliably supplying gas from liquid in a liquid reservoir at a given usage rate.

It is another object of this invention to provide an apparatus for more reliably supplying gas from liquid in a liquid reservoir at a given usage rate.

SUMMARY OF THE INVENTION

The above and other objects which will become apparent to those skilled in the art upon a reading of this disclosure are attained by the present invention, one aspect of which is:

A method for supplying gas to a receiving point at a flowrate at least equal to a design gas usage rate comprising:

(A) passing liquid from a liquid reservoir into an atmospheric vaporizer having a rated capacity at least equal to said design gas usage rate;

(B) passing liquid through the atmospheric vaporizer while heating the liquid by indirect heat exchange with ambient air to produce heated fluid;

(C) passing heated fluid from the atmospheric vaporizer into a powered heat exchanger having a rated capacity at least equal to said design gas usage rate;

(D) passing heated fluid through the powered heat exchanger while heating the heated fluid by indirect heat exchange with hot fluid to produce product gas; and (E) passing product gas to the receiving point at a flowrate at least equal to the design gas usage rate.

Another aspect of the present invention is:

Apparatus for supplying gas to a receiving point at a flowrate at least equal to a design gas usage rate comprising:

(A) a liquid reservoir;

(B) conduit means from the liquid reservoir to an atmospheric vaporizer having a rated capacity at least equal to said design gas usage rate;

(C) conduit means from the atmospheric vaporizer to a powered heat exchanger having a rated capacity at least equal to said design gas usage rate; and (D) conduit means from the powered heat exchanger to receiving point means comprising flow meter means to supply gas at a flowrate at least equal to said design gas usage rate.

As used herein the term "atmospheric vaporizer" means a unit for converting cryogenic liquid to warm gas by utilizing heat available from the ambient air. Generally, the atmospheric vaporizer will comprise a manifolded array of finned tubes with the liquid on the tubeside. Usually, the finned tubes, or integral extrusions, will be arranged vertically to enhance natural convection air circulation.

As used herein the term "rated capacity" means the maximum gas flowrate that can be supplied at the design conditions such as gas temperature and pressure.

As used herein the term "design gas usage rate" means the minimum gas usage rate that must be supplied to the usage point. When the usage point requires a constant flowrate of gas, this is the design flowrate. Generally the usage point requires gas at a flowrate which varies with time. In this case the design gas usage rate is the maximum value of the actual flowrate.

As used herein the term "indirect heat exchange" means the bringing of two fluids into heat exchange relation without any physical contact or intermixture of the fluids.

As used herein the term "powered heat exchanger" means a unit for converting cryogenic fluid to warm gas utilizing an external energy source such as steam, an electrical heater or fueled burner, wherein the cryogenic fluid is indirectly heated by a hot fluid, such as water or other heat transfer fluid which has been heated by the external energy source.

BRIEF DESCRIPTION OF THE DRAWING

The sole FIGURE is a simplified schematic representation of one embodiment of the apparatus of this invention which may be used to carry out the method of this invention.

DETAILED DESCRIPTION

The invention will be described in detail with reference to the FIGURE. Referring now to the FIGURE, cryogenic liquid is contained in liquid reservior 1. The liquid reservoir may be any suitable container and may be stationary or mobile. The FIGURE illustrates liquid reservoir 1 as a stationary liquid tank and shows cryogenic liquid being passed 2 into reservoir 1 such as from a truck tanker, railroad car or liquid production plant. Alternatively, the liquid reservoir could be a mobile unit such as a truck tanker or railroad car which is itself transported between the usage site and a source of liquid.

The cryogenic liquid may be any liquid which is a gas at ambient temperature and pressure conditions. Examples of cryogenic liquids include liquid oxygen, liquid nitrogen and liquid argon. The cryogenic liquid in liquid reservoir 1 is generally at a temperature below about −290° F.

The cryogenic liquid is passed from liquid reservoir 1 to atmospheric vaporizer 3 through conduit means 4. Any suitable atmospheric vaporizer may be employed in the practice of this invention. One preferred atmospheric vaporizer is the atmospheric vaporizer disclosed and claimed in U.S. Pat. No. 4,399,660 - Vogler, et al.

Atmospheric vaporizer 3 has a rated capacity at least equal to the design gas usage rate. The cyrogenic liquid is passed through atmospheric vaporizer 3, is heated by indirect heat exchange with ambient air, and is passed out of atmospheric vaporizer 3 as heated fluid. The liquid is vaporized and the resultant cold gas is then heated to close to ambient temperature. Generally, the gas will be warmed to within about 10° to 50° F. of the ambient temperature, preferably within about 20 to 30° F. of the ambient temperature. Generally, the heated gas will be at a temperature of at least about −50° F.

The heated fluid is passed from atmospheric vaporizer 3 through conduit means 5 to powered heat exchanger 6 which has a rated capacity at least equal to the design gas usage rate. In the embodiment illustrated in the FIGURE, powered heat exchanger 6 is a water bath heat exchanger which in the heated fluid is passed, within heat exchange passage, through a bath of hot water which is heated by injection of steam thereinto through steam lines 7 and 8. The heated fluid is passed through powered heat exchanger 6, is heated by indirect heat exchange with hot fluid, and is passed out of powered heat exchanger 6 as product gas. In the embodiment illustrated in the FIGURE the hot fluid is hot water. Preferably, the powered heat exchanger unit includes a reservoir of hot fluid sufficient to supply product gas for several hours without any energy supply. For example, the hot water can be stored at about 100° F. and can provide heated gas at a temperature of at least −50° F. for several hours, ranging from about 1 to 6 hours dependent on reservoir size.

Any other suitable type of powered heat exchanger may be used in the practice of this invention. Suitable powered heat exchangers could include use of other hot fluids such as a heat transfer fluid and use of other energy sources such as an electrical heater or fueled burner.

For normal operation of the gas supply system, the powered heat exchanger unit does only a little heating of the gas. Since the upstream atmospheric vaporizer is capable of supplying the required warm gas, the passage of that gas through the serially connected powered heat exchanger does not add significant heat. Usually, the additional heating is about 10° to 50° F. Thus, the normal operation would utilize primarily atmospheric heat and thereby conserve the external energy requirement. The marginal energy use by the powered heat exchanger can serve to periodically cycle the associated external energy supply, i.e., steam boiler and controls, and thereby enhance the overall system reliability. However, if there is degradation of performance for the atmospheric vaporizer, then the product gas can receive additional heat input from the powered heat exchanger. For the worst scenario, if the atmospheric vaporizer becomes badly fouled with frost and ice and becomes essentially inoperative, the powered heat exchanger receives liquid and produces the warm product gas.

Product gas is passed from powered heat exchanger 6 through conduit means 9 to receiving means 10 which comprises flow meter means 11 set to measure the product gas flowrate. The gas usage rate is the rate at which the product gas is used by the usage point or points. Typical examples of life support, heat treating furnaces which use nitrogen for inert gas purging of furnace atmospheres, and steel mills which use argon for steel refining and for inert gas blanketing of molten steel.

The gas usage rate may be any flowrate and depends upon the nature and size of the usage point. Typical usage rates for hospitals may be from as small as 1000 SCFH (standard cubic feet per hour) to as large as 250,000 SCFH.

The system monitor 12 illustrated on the FIGURE indicates that various system parameters are measured and monitored to determine system status. For example, the liquid reservoir contents, the heat exchanger exit gas temperatures, and the powered heat exchanger hot fluid temperature, can all be monitored and the information used to indicate system malfunctions. The monitoring system is a preferred, but does not constitute a necessary, function of the system of this invention.

The present invention provides a much more reliable gas supply system than heretofore available systems. If the atmospheric vaporizer becomes unexpectedly fouled due to frost or ice buildup, the powered heat exchanger, by virture of its defined rated capacity, can supply product gas to the usage point at the design usage rate. If the powered heat exchanger loses power, the atmospheric vaporizer, by virtue of its defined rated capacity, can supply product gas to the design usage point at the design usage rate. Thus both of these independent failure modes are overcome by the invention while still delivering product gas to the usage point at the usage rate.

Moreover, the present invention provides product gas to the usage point at the usage rate even in the highly unlikely event of the simultaneous occurrence of both of the failure modes. This unexpected and very advantageous result is demonstated by the following calculated example which is presented for illustrative purposes and is not intended to be limiting.

EXAMPLE

A use point uses nitrogen gas at a design usage rate of 250,000 SCFH and requires the nitrogen gas at a minimum temperature of 50° F. Liquid nitrogen is passed out from a liquid storage tank as a saturated liquid at a temperature of −264° F. and a pressure of 100 pounds per square inch absolute (psia). The nitrogen is passed through a system similar to that illustrated schematically in the FIGURE.

The liquid nitrogen is passed into and through an atmospheric vaporizer having a rated capacity of 25,000 SCFH and is heated by indirect heat exchange with ambient air.

The heated nitrogen is then passed into and through a steam heated water bath heat exchanger having a rated capacity of 250,000 SCFH and is heated by indirect heat exchange with hot liquid water, which is at a temperature of 130° F., to produce product nitrogen gas which is passed through a flowmeter to the usage point at a rate of 250,000 SCFH and at a temperature of 50° F. or greater.

Both independent failure modes occur simultaneously. The atmospheric vaporizer becomes fouled due to frost buildup and steam flow to the water bath is cut off. The heated nitrogen emerges from the atmospheric vaporizer at a temperature of −50° F., is passed through the water bath heat exchanger and through the flowmeter to the usage point at a rate of 250,000 SCFH and at a temperature of at least 50° F., and continues at this rate and temperature for 4 hours after the simultaneous double failure. The 4 hour period enables sufficient time to identify and rectify at least one of the failures to enable continued product gas supply to the use point at the usage rate without interruption.

Now by the use of the method and apparatus of this invention, one can reliably supply gas to a use point at a given usage rate without interruption due to unexpected fouling or power loss.

Although the invention has been described in detail with reference to a particular embodiment, those skilled in the art will recognize that there are other embodiments of the invention within the spirit and scope of the claims.

We claim:

1. A method for supplying gas to a receiving point at a flowrate at least equal to a design gas usage rate comprising:

(A) passing liquid from a liquid reservoir into an atmospheric vaporizer having a rated capacity at least equal to said design gas usage rate;

(B) passing the liquid through the atmospheric vaporizer while heating the liquid by indirect heat exchange with ambient air to produce heated fluid;

(C) passing substantially all of the heated fluid from the atmospheric vaporizer into a powered heat exchanger having a rated capacity at least equal to said design gas usage rate;

(D) passing the heated fluid through the powered heat exchanger while heating the heated fluid by indirect heat exchange with hot fluid to produce product gas: and (E) passing product gas to the receiving point at a flowrate at least equal to the design gas usage rate.

2. The method of claim 1 wherein the gas is oxygen.

3. The method of claim 1 wherein the gas is nitrogen.

4. The method of claim 1 wherein the gas is argon.

5. The method of claim 1 wherein the design usage rate is at least 1000 SCFH.

6. The method of claim 1 wherein the hot fluid is hot water.

7. The method of claim 1 wherein the hot fluid is contained in a resevoir in an amount sufficient to produce product gas for a period of up to six hours without heating of the hot fluid by the powered heat exchanger during said period.

8. The method of claim 1 wherein the heated fluid passing through the powered heat exchanger is heated only marginally and the energy source supplying heat to the hot fluid is cycled on and off.

9. The method of claim 1 further comprising monitoring the liquid reservoir contents, the heat exchanger exit gas temperatures and/or the powered heat exchanger hot fluid temperature.

10. Apparatus for supplying gas to a receiving point at a flowrate at least equal to a design gas usage rate comprising:

(A) a liquid reservoir;

(B) conduit means from the liquid reservoir to an atmospheric vaporizer having a rated capacity at least equal to said design gas usage rate;

(C) conduit means for supplying substantially all of the output from the atmospheric vaporizer to a powered heat exchanger having a rated capacity at least equal to said design gas usage rate; and (D) conduit means from the powered heat exchanger to receiving point means comprising flow meter means to supply gas at a flowrate at least equal to said design gas usage rate.

11. The apparatus of claim 10 wherein the liquid reservoir is a stationary tank.

12. The apparatus of claim 10 wherein the liquid reservoir comprises mobile tankage.

13. The apparatus of claim 10 wherein the powered heat exchanger is a steam heated water bath containing hot liquid water.

14. The apparatus of claim 10 wherein the powered heat exchanger comprises a hot fluid reservoir of a size sufficient to produce product gas for a period of up to six hours without heating of the hot fluid by the powered heat exchanger during said period.

15. The apparatus of claim 10 wherein the powered heat exchanger comprises an electrical heater.

16. The apparatus of claim 10 wherein the powered heat exchanger comprises a fueled burner.

17. The apparatus of claim 10 further comprising monitoring means capable of monitoring the contents of the liquid reservoir, the temperature of fluid in the conduit means from the liquid reservoir to the atmospheric vaporizer, the temperature of fluid in the conduit means from the atmospheric vaporizer to the powered heat exchanger, and/or the temperature of hot fluid within the powered heat exchanger.

* * * * *

UNITED STATES PATENT AND TRADEMARK OFFICE

CERTIFICATE OF CORRECTION

PATENT NO. : 4,821,523

DATED : April 18, 1989

INVENTOR(S) : J.P. Borcuch et al

It is certified that error appears in the above-identified patent and that said Letters Patent is hereby corrected as shown below:

In column 2, line 9 delete "or" and insert therefor --of--.

In column 4, line 38 between "exchanger" and "the" delete "which in" and insert therefor --wherein--.

In column 5, line 16 between "of" and "life" insert --usage points include hospitals which use oxygen for--.

In column 5, line 66 delete "25,000" and insert therefor --250,000--.

Signed and Sealed this

Seventh Day of November, 1989

*Attest:*

JEFFREY M. SAMUELS

*Attesting Officer* *Acting Commissioner of Patents and Trademarks*